US011712106B2

(12) United States Patent
Richardson

(10) Patent No.: US 11,712,106 B2
(45) Date of Patent: Aug. 1, 2023

(54) ERGONOMIC WATER BLADDER

(71) Applicant: Byram T. Richardson, Atlanta, GA (US)

(72) Inventor: Byram T. Richardson, Atlanta, GA (US)

(73) Assignee: Barh Life, Inc., Atlanta, GA (US)

( * ) Notice: Subject to any disclaimer, the term of this patent is extended or adjusted under 35 U.S.C. 154(b) by 0 days.

(21) Appl. No.: 16/706,745

(22) Filed: Dec. 7, 2019

(65) Prior Publication Data

US 2021/0321751 A1 Oct. 21, 2021

Related U.S. Application Data

(60) Provisional application No. 62/776,912, filed on Dec. 7, 2018.

(51) Int. Cl.

| | |
|---|---|
| ***A45F 3/20*** | (2006.01) |
| *A45F 3/00* | (2006.01) |
| *A45F 3/16* | (2006.01) |

(52) U.S. Cl.

CPC ..... *A45F 3/20* (2013.01); *A45F 2003/003* (2013.01); *A45F 2003/163* (2013.01); *A45F 2003/166* (2013.01)

(58) Field of Classification Search

CPC ..... A45F 3/16; A45F 3/20; A45F 2003/166; A41D 2400/46; A47G 21/187

USPC ..... 224/148.1–148.7

See application file for complete search history.

(56) References Cited

U.S. PATENT DOCUMENTS

| | | | | |
|---|---|---|---|---|
| 5,282,557 A * | 2/1994 | McCook | A45F 3/16 | 222/175 |
| 5,947,378 A * | 9/1999 | Rebotier | A47G 21/187 | 239/33 |
| 6,685,072 B2 * | 2/2004 | Ho | A45F 3/04 | 224/629 |
| 7,490,740 B2 * | 2/2009 | Robins | A45F 3/20 | 222/175 |
| 8,020,730 B2 * | 9/2011 | Liang | A45F 3/04 | 224/148.4 |

(Continued)

OTHER PUBLICATIONS

Iphonefaq.org (www.iphonefaq.org/archives/975404), visited on Jun. 15, 2017 via the Wayback Machine. (Year: 2017).*

(Continued)

*Primary Examiner* — Scott T McNurlen

(74) *Attorney, Agent, or Firm* — Baker, Donelson, Bearman, Caldwell & Berkowitz, PC

(57) ABSTRACT

A "Wing-shaped" liquid bladder device is disclosed having angular shoulder wings on the left and right sides. The wings join at an angle creating a substantially "V-Shaped" hollow volume for storing liquids. A re-sealable opening receptacle can be found on top the bladder for filling the hollow volume. One or more additional arms can be added to the wings. The wings and arms meet at a lower distal end to create a substantially "V-shaped" funnel that is attached to an outlet pipe. In the front, shoulder straps are attached to the wings and they go over and across the front of the wearer's body to a lower portion of the arms of the bladder. The outlet pipe is attached to the funnel and extends up to the wearer's shoulder. A drinking straw can be attached to the outlet pipe to allow the user to easily access the liquids inside.

18 Claims, 7 Drawing Sheets

(56) References Cited

U.S. PATENT DOCUMENTS

| | | | | |
|---|---|---|---|---|
| 8,357,020 | B2 * | 1/2013 | Hansbro | B63C 9/115 441/106 |
| 9,585,462 | B2 * | 3/2017 | Engdahl | A45F 3/10 |
| 10,188,230 | B2 * | 1/2019 | Hambrock | G01F 1/075 |
| 2008/0179356 | A1 * | 7/2008 | Edy | A45F 3/20 224/148.2 |
| 2008/0217367 | A1 * | 9/2008 | Lillie | A45F 3/047 224/148.2 |
| 2013/0277991 | A1 * | 10/2013 | Wu | A45C 13/30 294/25 |
| 2015/0053718 | A1 * | 2/2015 | Lyon | B65D 47/06 222/129 |

OTHER PUBLICATIONS

Phonearena.com (www.phonearena.com/news/Apple-iPone-5-has-three-microphones-and-HD-voice-support-whats-in-it-for-you_id34486), published Jun. 17, 2014 (Year: 2 014).*

* cited by examiner

ERGONOMIC WATER BLADDER

CROSS-REFERENCE TO RELATED APPLICATION

This application claims the benefit of U.S. Provisional Application No. 62/776,912 filed Dec. 7, 2018, which is incorporated herein by reference.

FIELD OF THE INVENTION

The invention relates to an improved designed for wearable water bladder system that is has a lower center of gravity, ergonomic design, and is temperature isolated from the wearer.

BACKGROUND OF THE INVENTION

Consumers are becoming increasing health conscious and knowledgeable about the benefits of staying hydrated, particularly by drinking water. However, when a consumer is working, work out, running, or otherwise engaged in physical activity, it is difficult to carry and access water or liquid containers. What was needed is a container that allows a consumer to engage in physical activities while still having the opportunity to quickly engage and access all the of liquids in the container.

Prior inventions such as rigid metal or plastic containers, like water canteens, were simply too bulky to carry and use while engaging in activities. Other prior art systems sought to solve this problem by creating a straw attached to the bottom of a water bag. However, these systems required a separate container unit to carry and hold the water bag when the user was in motion. These separate container units shield the user from the sweat produced by the liquids in the water bags while also shielding the liquid contained in the water bag from the user's body heat. Often times the square or rectangular shape of the water bag meant that at times all the liquid in the bag could not be accessed as the water retreated to the corners of the bag. Furthermore, the shape of the bag often meant the container would collapse around the straw opening, clogging the suction system and thereby limiting access to the liquids contained therein.

A new type of liquid or water container is needed that allows for a non-bulky, comfortable ergonomic design that is easy to wear, allows for easy access of the liquids inside, and avoids the problems of the prior art systems.

The present invention meets one or more of the above-referenced needs as described herein in greater detail.

SUMMARY OF THE INVENTION

The present invention contemplates a novel construction of a liquid bladder device to allow for the convenient and ergonomic transport by a single person of an adequate water supply, equal to or substantially exceeding that of a conventional water canteen. Briefly described, aspects of the present invention include the following.

In a first embodiment of the present invention a uniquely "Wing-shaped" liquid bladder device is disclosed. The liquid bladder device has two, separate, angular shoulder wings one of which is position to the right, and the other positioned to the left. The two shoulder wings join at an angle creating a substantially "V-Shaped" hollow volume for storing liquids. At an upper distal end of the left and/or right wings, a re-sealable opening receptacle can be found for filling the hollow volume. A re-sealable opening can also be placed on other areas of the bladder. For additional capacity, on the left wing and the right wing, one or more additional arms can be added, also joining the wings at an angle, creating a similar "V-shape" along the side of the shoulder wings of the device. All of the wings meet at a lower distal end to create a substantially "V-shaped" funnel that is attached to a pipe for retrieving the liquids. Buckles or other receptacles are provided for attaching one or more shoulder straps along the upper distal ends of each of the left and right wings. The buckles can have one or more loops. These buckles can be fixedly attached to the wings. The buckles can also be removably attached to the wings, such as when the re-sealable receptacle openings are being resealed, the wings can wrap around a loop of the buckle to complete the sealing process. Buckles are also attached to distal ends of each of the additional arms of the liquid bladder. Shoulder straps are connected between the buckles of the wings and the buckles mounted on arms of the liquid bladder. In a further embodiment, the shoulder straps can connect to create an "X" shape across the user's chest. In another embodiment, the shoulder straps can be an equivalent width to the wings at the buckle straps, the shoulder straps then decrease in width as they meet in the center—where the center of the "X-shape" is created—to provide more comfort to the user. The width of the shoulder straps is designed to offset the weight of the "Wing-shaped" liquid bladder device. The shoulder straps can attach to an "O-ring" via an attachment means such as the hook and fastener type to allow for easy adjustability. This allows the "Wing-shaped" liquid bladder device to comfortably fit a male or female body type.

In another aspect of the invention, the liquid bladder is comprised of a silicone/plastic blend, anti-molding material. A pipe can be fixed or removably attached from the center of the "V-shaped" funnel and incorporated into the seams of the bladder on the left or right side of device all the way to an upper distal end of the left or right wings of the device. In another aspect, the pipe can be fixed or removably attached to the "V-shaped" funnel and laid across the rear facing surface of the device all the way to an upper distal end of the left or right wings of the device using a hook and fastener, hoop channels, or other attachment means. In a further embodiment, the pipe can be incorporated to the wings on the left and right sides of the device. In another embodiment, the "Wing-shaped" liquid bladder device is divided along its centerline into left and right portions, creating separate left and right chambers for liquids. These separate left and right chambers can contain two different types of liquids. These separate left and right chambers for liquids flow respectively, into segregated left and right portions of the V-shaped funnel at a lower distal end of the device. The segregated left and right portions of the V-shaped funnel flow into separate pipes on the left and right sides of the bladder that are incorporated into the wings on the left and right sides. In either configuration, the attached pipes can include a sealable faucet for attaching a drinking straw for accessing the liquid(s) inside.

In a further aspect of the invention, the drinking straws are wide and flat in shape for improved handing and water flow. In still another embodiment, the flat, flexible drinking straw includes a freezable component positioned inline to the center of the straw to cool the water or liquid that passes over it. In still another aspect, a water filtration component can be placed in-line with the water flow of the pipe into the drinking straw, thereby allowing the user access to clean filtered water.

In still further aspects of the invention, a fluid flow sensor can be placed in-line with the water flow of the pipe into the drinking straw. The fluid flow sensor can include wired or wireless connectivity to a computing device such a mobile phone, tablet, or laptop to track a user's hydration and water consumption. A motion sensor can also be attached to the "Wing-shaped" liquid bladder device to track a user's motion, steps, and other physical activities. Similarly, a heart rate monitor can be placed along the straps of the device for measuring and tracking a user's heart rate. Data from the fluid flow sensor, the motion sensor, and heart rate monitors can be used in combination on the computing device to access a user's health, activity, and hydration levels. The system can then make fitness, health, and hydration recommendations to the user based upon this data.

In still a further aspect of this invention, the "Wing-shaped" liquid bladder device can be assembled using military grade Poly-paraphenylene terephthalamide (known commercially as Kevlar) material to provide both hydration and physical protection for the users. In still a further aspect of this invention, wired or wireless speakers and microphones can be placed on the shoulder straps of the device to enable the user to listen to audio or take a phone call while using the "V-shaped" liquid bladder device.

In a second embodiment of the invention, the "Wing-shaped" liquid bladder device has rear portion that faces the users clothing or the ambient environment. The "Wing-shaped" liquid bladder device also a front or body-facing side that can come into contact with the user's body. This body-facing side can incorporate a series of spaced-apart bumps or other protrusions that stick out from the flat surface of the "Wing-shaped" liquid bladder device. These bumps allow airflow around between the surface of the "Wing-shaped" liquid bladder device and the user's body. This eliminates the likelihood that the "Wing-shaped" liquid bladder device might stick to the user's back when the user perspires. It also reduces heat transfer between the user and the "Wing-shaped" liquid bladder device.

In a second embodiment of the invention, the liquid bladder device can include a shape similar to a vest with a pointed tail funnel. These "vest-shaped" liquid bladders would also comprise a "V-shaped" funnel along is lower central portion to draw the center of gravity down and force all fluid flow to its funnel. These "vest-shaped" liquid bladders would have similar upper left and right shoulder portions for attaching to a front chest strap or other mounting means, such as a front flak jacket or vest. The "vest-shaped" liquid bladders can hold a larger volume of liquid and can be filled via a re-sealable opening along a top portion of its upper distal end.

In a third embodiment of the invention, a "collar-shaped" liquid bladder that is mounted around the neck of a dog, cat, or similar pet is offered. This "collar-shaped" liquid bladder has a distal end with a re-sealable opening for liquids such as water. On an opposite distal end, the "collar-shaped" liquid bladder has a manual squeeze pump for pulling the liquid out of the bladder and forcing it through a drinking attachment such as straw. The drinking attachment can be fixed or removable attached to the "collar-shaped" liquid bladder and it can include a straw or trough for quickly dispensing water or liquid to a pet.

The above features as well as additional features and aspects of the present invention are disclosed herein and will become apparent from the following description of preferred embodiments of the present invention.

This summary is provided to introduce a selection of aspects and concepts in a simplified form that are further described below in the detailed description. This summary is not intended to identify key features or essential features of the claimed subject matter, nor is it intended to limit the scope of the claimed subject matter.

BRIEF DESCRIPTION OF THE DRAWINGS

The foregoing summary, as well as the following detailed description of illustrative embodiments, is better understood when read in conjunction with the appended drawings. For the purpose of illustrating the embodiments, there is shown in the drawings, exemplary constructions of the embodiments; however, the embodiments are not limited to the specific methods and instrumentalities disclosed. In the drawings.

DETAILED DESCRIPTION

Brief Description of the Drawings

Figure 1:
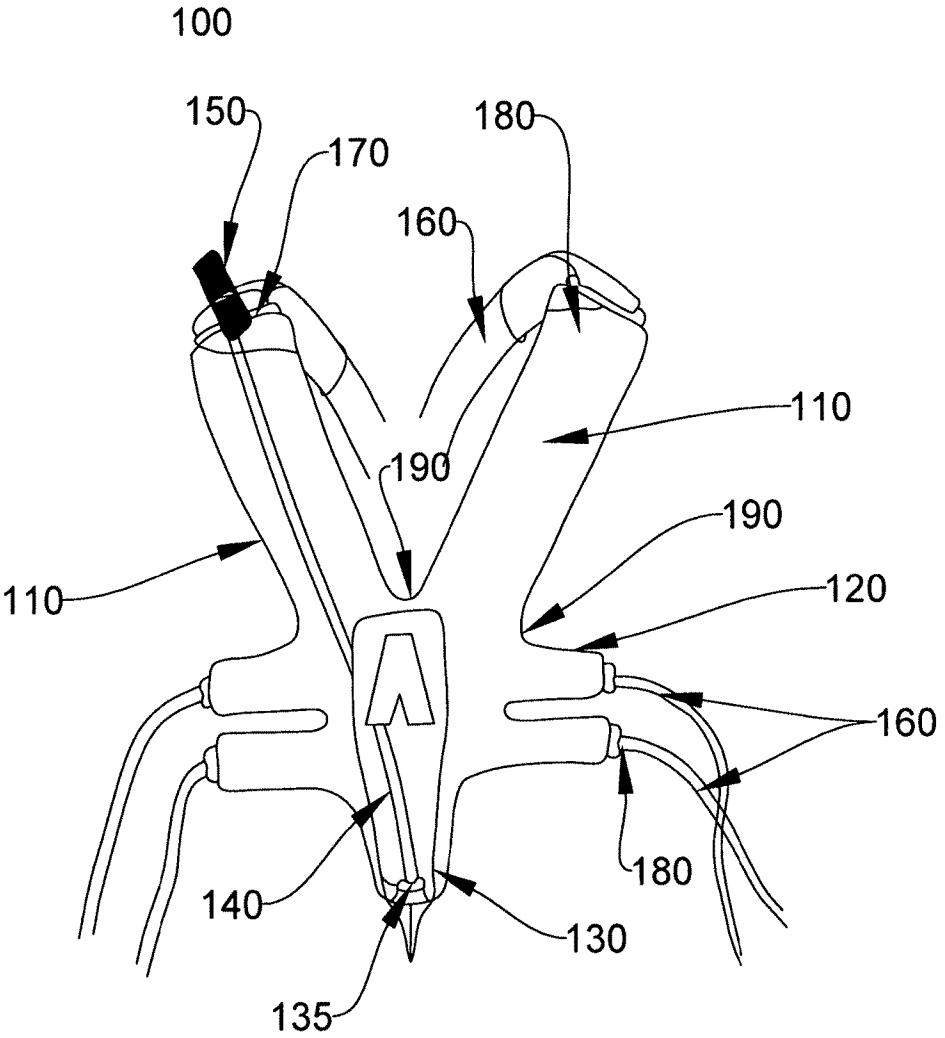
FIG. 1 is a reward facing view of the Wing-shaped liquid bladder, attached shoulder straps, and straw.

Before the present device, methods and systems are disclosed and described in greater detail hereinafter, it is to be understood that the devices, methods and systems are not limited to specific devices, methods, specific components, or particular implementations. It is also to be understood that the terminology used herein is to describe particular aspects and embodiments only and is not intended to be limiting.

As used in the specification and the appended claims, the singular forms "a," "an" and "the" include plural referents unless the context clearly dictates otherwise. Similarly, "optional" or "optionally" means that the subsequently described feature or component may or may not be included, and the description includes instances where the feature or component is included and instances where it is not included.

Throughout the description and claims of this specification, the word "comprise" and variations of the word, such as "comprising" and "comprises," mean "including but not limited to," and is not intended to exclude, for example, other components, integers or steps. "Exemplary" means "an example of" and is not intended to convey an indication of preferred or ideal embodiment. "Such as" is not used in a restrictive sense, but for explanatory purposes.

Disclosed are components that can be used to perform the disclosed device, methods, and systems. These and other specific components are disclosed herein. It is understood, however, that when combinations, subsets, interactions, groups, etc. of these components are disclosed with specific reference to each of the various individual and collective combinations, there can be permutations of these combinations or groups that are not explicitly disclosed. However, each of these groups and combinations of components are specifically contemplated and described herein to arrive at the invention for each device, method, or system. This applies to all aspects of this specification including, but not limited to, combinations of described device components. Thus, if there are a variety of component combinations that can be assembled with the liquid bladder device, it is understood that each of the additional component combinations may be used with any of the specific embodiments or combination of embodiments of the disclosed liquid bladder device.

As will be appreciated by one skilled in the art, the methods and systems may take the form of an entirely new hardware embodiment, an entirely new software embodiment, or an embodiment combining new software and hardware aspects. References are made herein to the attached drawings. Like reference numerals are used throughout the drawing to depict like or similar elements of the liquid bladder device, its shoulder and chest straps, and other accessories. For the purposes of presenting a brief and clear description of the present invention, the preferred embodiment will be discussed as a wing-shaped liquid bladder used to carry and dispense drinking water to a user. The figures are intended for representative purposes only and should not be construed to be limiting in any aspect.

Referring now to FIG. 1, there is shown a rear facing perspective view of the present invention. The present invention consists largely of a winged shaped, liquid bladder 100. The liquid bladder 100 has a substantially V-Wing shape. The "wings" of the bladder include left and right wings 110 that extend to an upper distal end extend to the left and right shoulders of the user respectively. The left and right wings 110 come together near the lower back to form a "V-shaped" junction 190. Along this "V-shaped" junction 190 additional arms 120 can also extend out, creating additional "V-shaped" junctions 190 between the arms 120 and the wings 110. Each of the arms and wings are attached at an angle so that they pour into a seamlessly attached "V-shaped" funnel 130 along a lower distal end of the Wing-shaped bladder 100. In another embodiment, each of the arms and wings are attached at an angle so that they pour into a seamlessly attached "half-moon shaped," "W-shaped," or "U-shaped" funnel 130 along a lower distal end of the Wing-shaped bladder 100. An outlet pipe 140 is fixedly or removably attached to the outlet of this V-shaped funnel 130. The outlet pipe 140 attaches to a drinking straw 150 or other component along its upper distal end. Also along the upper distal end of the wings 110, a shoulder strap 160 for mounting the winged-shaped liquid bladder 100 on to the user's body for transport can be found. The shoulder straps 160 are attached the left and right wings 110 via a buckle 180 mounted at the upper distal end of each of the left and right wings 110. The shoulder straps 160 attach to a distal end of the arms 120 via buckles 180 to form a loop, which allows the user to place the winged-shaped liquid bladder 100 over their shoulders. The angled "V-shaped" connection of the wings 110 and arms 120 to the "V-shaped" funnel 130 means all the liquid in the bladder are directed to the outlet 135 connected to the pipe 140. This forces to the center of gravity of the winged-shaped liquid bladder 100 to the funnel 130 and thus, all the liquid in the device flows to this portion, all while allowing the bladder 100 to be worn comfortably on the user's back.

In another aspect of the invention, the liquid bladder 100 is comprised of a silicone/plastic blend, anti-molding material. The outlet pipe 140 can be fixed or removably attached from the center of the "V-shaped" funnel 130 and incorporated into the seams of the bladder 100 along the left or right wings 110 of device all the way to an upper distal end of the left or right wings 110 of the bladder device 100. In another aspect, the outlet pipe 140 can be fixed or removably attached to the "V-shaped" funnel 130 and laid across the rear facing surface of the device 100 along the path to an upper distal end of the left or right wings 110 of the device 100 using a hook and fastener, hoop channels, or other attachment means. In a further embodiment, the outlet pipe 140 can be incorporated to the wings 110 on the left and right sides of the device 100.

Figure 6:
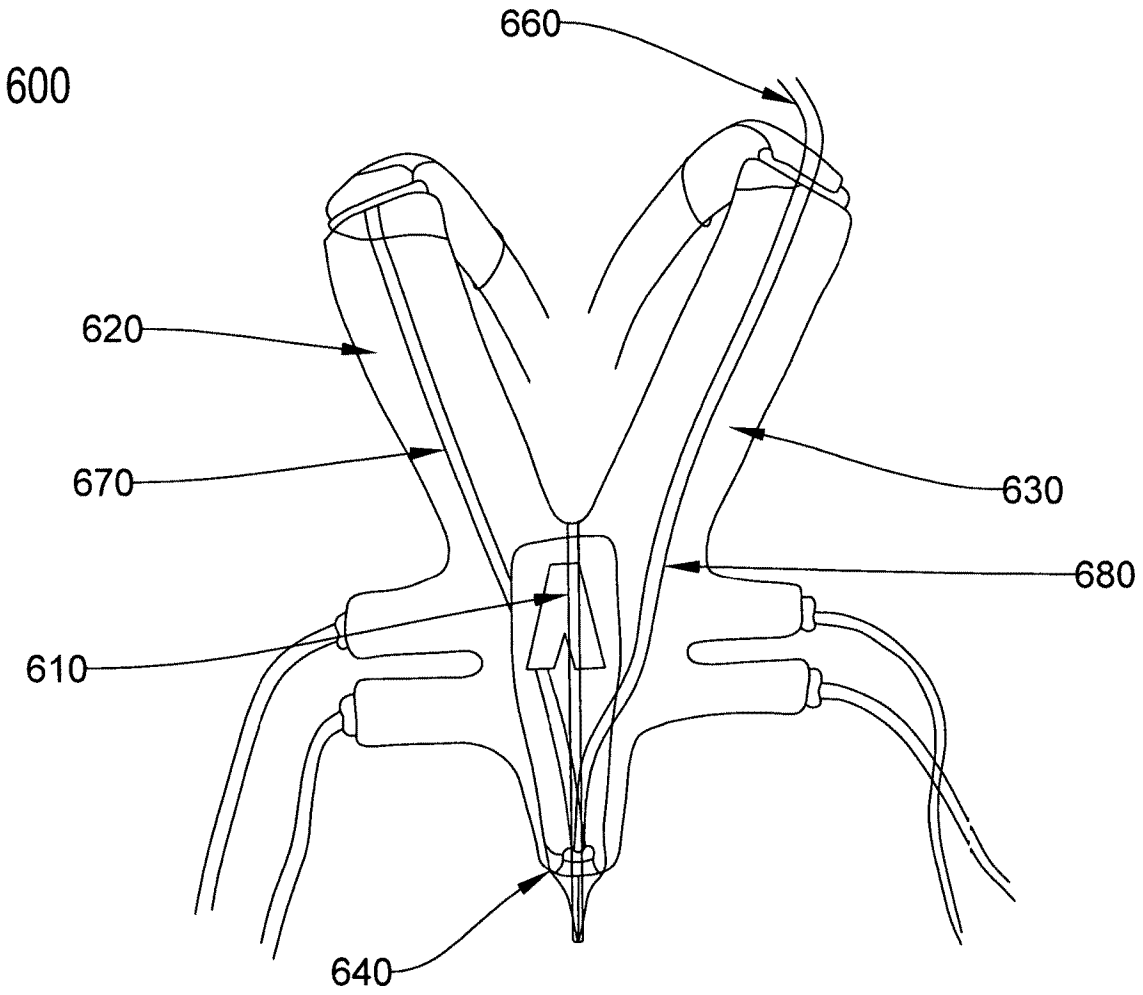
FIG. 6 is a rear facing view of the vest-shaped liquid bladder.

In another embodiment, illustrated in FIG. 6 the "Wing-shaped" liquid bladder device 600 is divided along its centerline 610 into left and right portions, creating separate left 620 and right 630 chambers for liquids. These separate left and right chambers 620, 630 can contain two different types of liquids. These separate left and right chambers 620, 630 for liquids flow respectively, into segregated left and right portions 620, 630 of the V-shaped funnel 640 at a lower distal end of the device 600. The segregated left and right portions of the V-shaped funnel 640 flow into separate pipes 670, 680 on the left and right sides of the bladder 620, 630 that are incorporated into the wings on the left and right sides.

Figure 2:
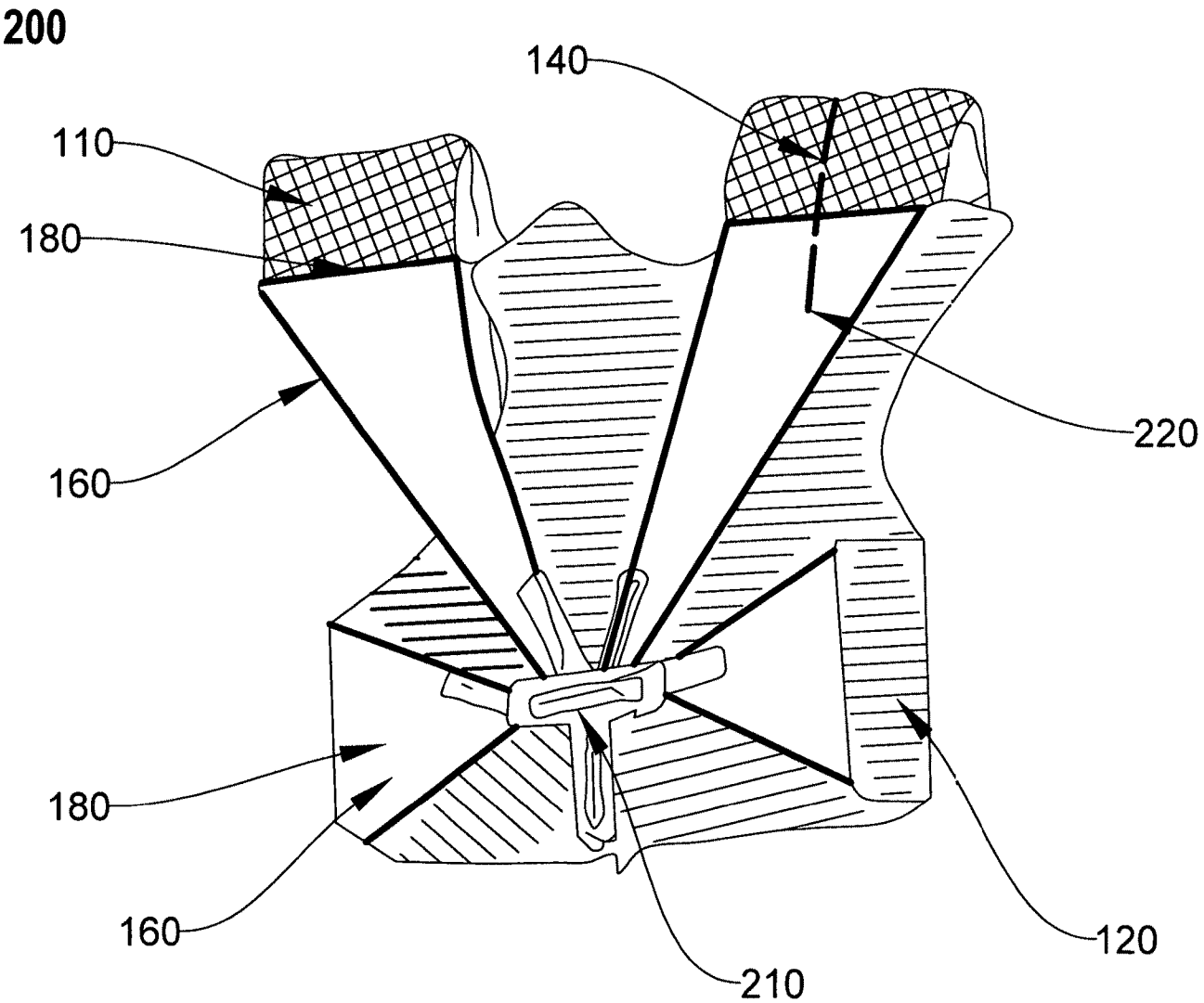
FIG. 2 is a front facing view of the Wing-shaped liquid bladder's X-shaped chest and shoulder straps.

Referring now to FIG. 2, a front facing view 200 of the winged-shaped liquid bladder 100 is illustrated. The wings 110 of the bladder 100 attach to buckles 180 that are connected to shoulder straps 160 for wearing the bladder device 100. The arms 120 are also attached to buckles 180 and shoulder straps 160. At a distal end opposite the buckles 180, each of the shoulder straps 160 meet a fastener 210 to complete loops that allow the bladder device 100 to be placed over the user's shoulder. The fastener can comprise a hook and fastener design that allows the ends of the wing straps to grasp an O-ring, or any other suitable fastener design. Once the bladder device 100 is mounted on a user's back the user can access the liquids contained therein via a drinking straw 220 that is removably or fixedly attached to the pipe 140.

Figure 3:
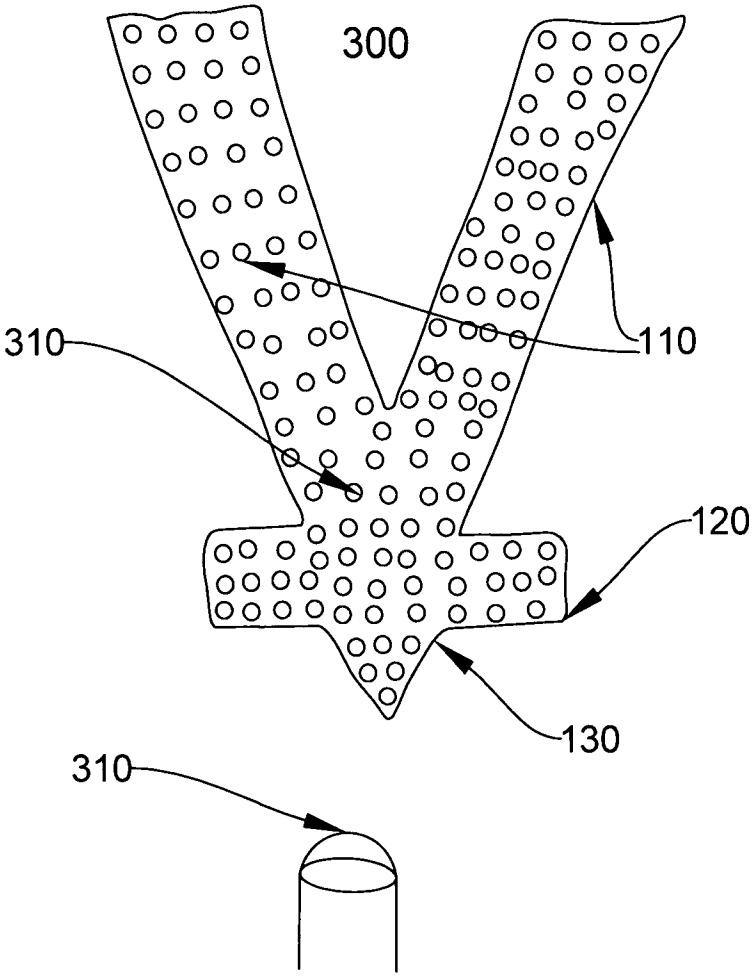
FIG. 3 is a body-facing view of the dimpled back of the Wing-shaped liquid bladder for allowing airflow between the bladder and the user's back.

In a further aspect, referencing FIG. 3 a body-facing view of the liquid bladder 100 is illustrated. Here we see the body-facing portions of the wings 110, arms 120, and funnel 130. Although the body-facing portion of the liquid bladder 100 has a substantially flat surface, protruding bumps 310 can be present. These protruding bumps 310 allow airflow to pass between the surface of the liquid bladder 100 and the user's body. This prevents the liquid bladder 100 from sticking to the user's back, sweat being transferred from the bladder to the user and vice versa, and it slows heat transfer between the user and the liquid bladder 110.

Figure 4:
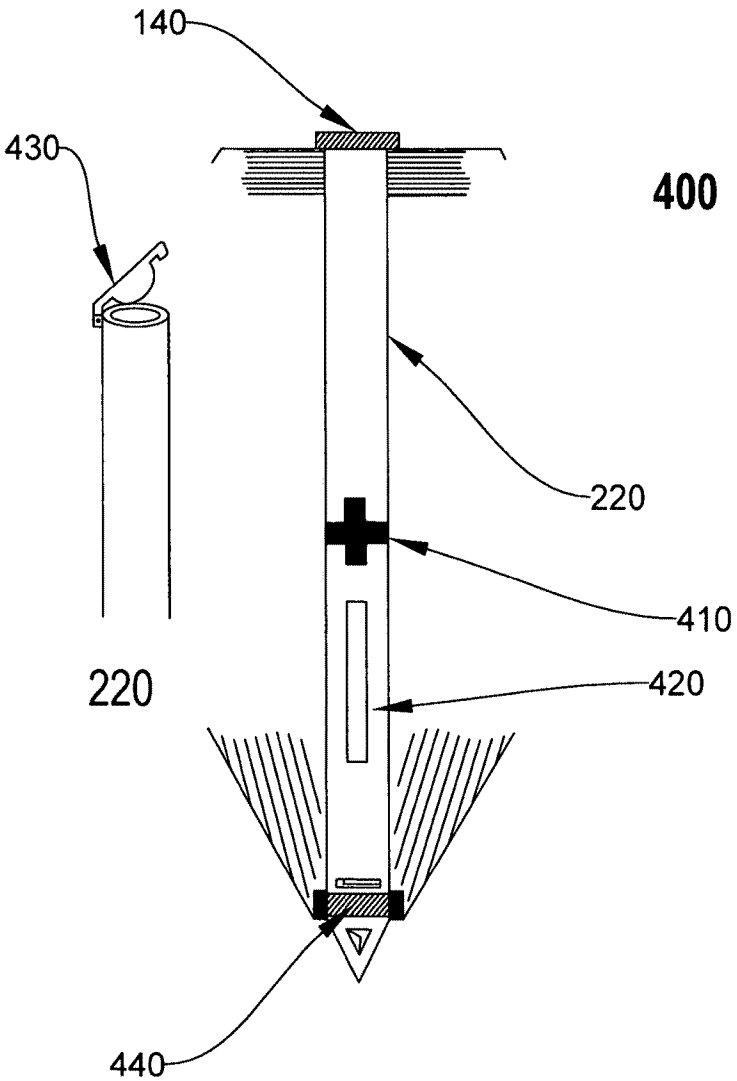
FIG. 4 is an illustration of the drinking straw insert that allows the water to be cooled as it passes over the insert.

Turning now to FIG. 4 the handle drinking straw 220 and its associated components are illustrated. The outlet pipe 140 attaches to the drinking straw 220 to allow the user to access the liquids in the bladder 110. In-line with the drinking straw 220 and/or the outlet pipe 140 a fluid flow sensor 410 can be mounted to measure the amount of liquid dispensed by the device. This fluid flow sensor can be electrically or mechanically powered and can communicate with a computing device via wired or wireless technologies. The data gathered by the fluid flow sensor 410 can be analyzed by an application on the computing device and provide feedback regarding hydration needs to the user. A cooling device can also be placed in-line with the drinking straw 220 and/or the outlet pipe 140. The cooling device can comprise a sealed cylinder 420 filled with a freezable gel, liquid, dry ice, or a freezable stainless steel or other inert, conductive metal; such that the cylinder cools the temperature of the fluid (water) as it flows around the cylinder 420. Finally, in embodiment, the drinking straw 220 can contain a filter 440 for filtering the liquid as it passes through the straw 220.

Figure 5:
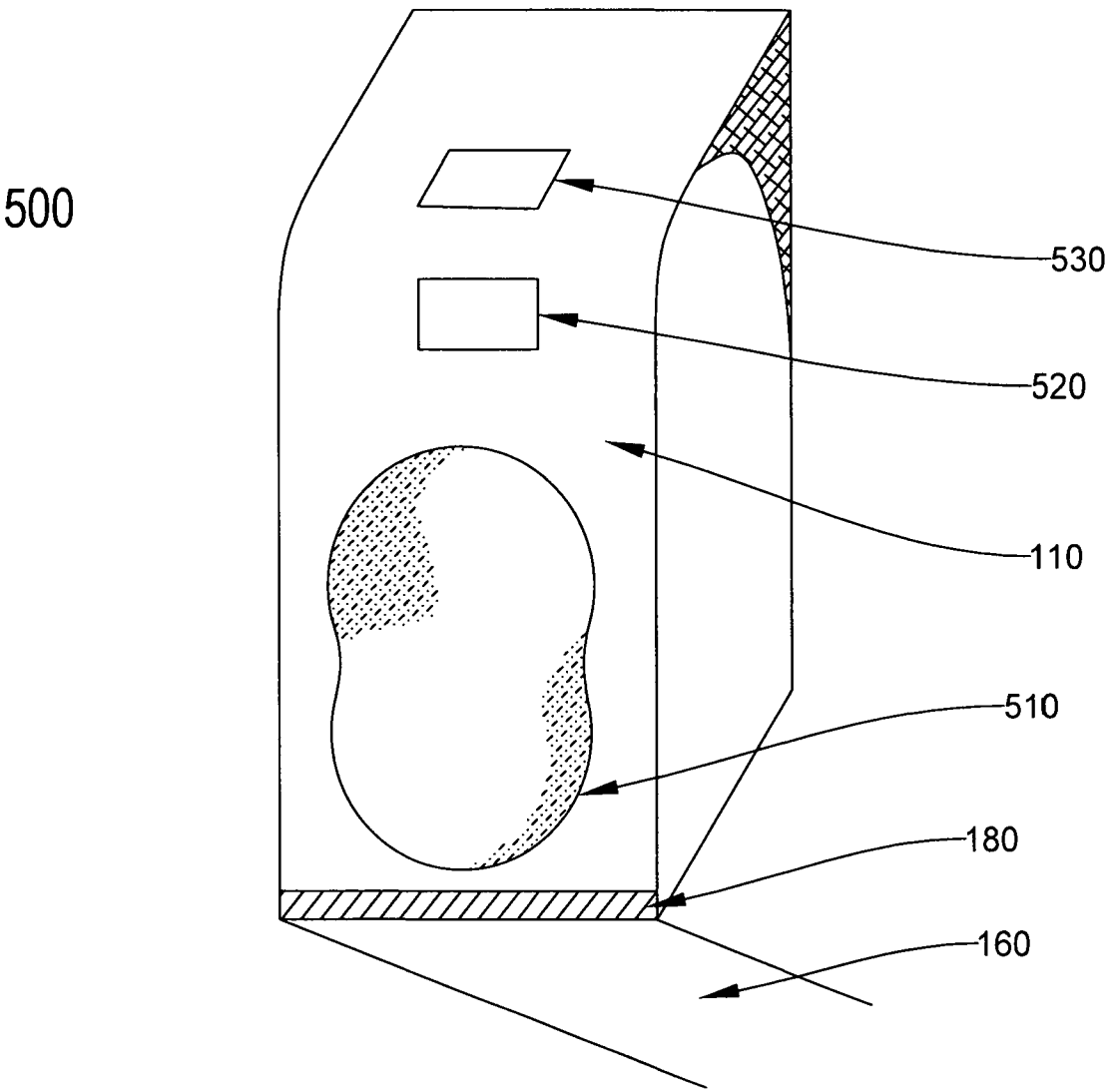
FIG. 5 is an illustration of accessories mounted on the wing-shaped liquid bladder and its shoulder straps including motion sensors, heart rate monitors, speakers and microphones.

Turning now to FIG. 5, a number of accessories can be attached to the liquid bladder device 100. This can include a wired or wireless speaker and microphone 510 mounted on the liquid bladder 100 or its shoulder straps 160. These features would allow the user to listen to Audio or take a call while wearing the liquid bladder device 100. Similarly, sensors such as a heart rate monitor 420 or motion sensor 530 can be incorporated into the liquid bladder 100 or its shoulder strap 160 design to allow the device to communicate with a computing device such as a smart phone, tablet, or computer. Data gathered from the sensors could also be used to provide feedback to the user regarding the user's health statistics.

In still an alternative embodiment, as illustrated in FIG. 6, vest-shaped design is illustrated. Here the entire bladder 600 is shaped like a wearable vest. The left and right wings 610 attach to a buckle 680 and shoulder straps 660 along an upper distal end. Along a lower distal end, a V-shaped funnel 630 can be found. The outlet pipe 640 is attached to the funnel outlet and carries the fluids back up to the drinking straw of the user near the upper distal end of the left or right wings 610. The lower rear shape of the vest-shaped bladder 600 is substantially V-shaped to allow all of the liquids in the vest to pour into the funnel portion 630.

Figure 7:
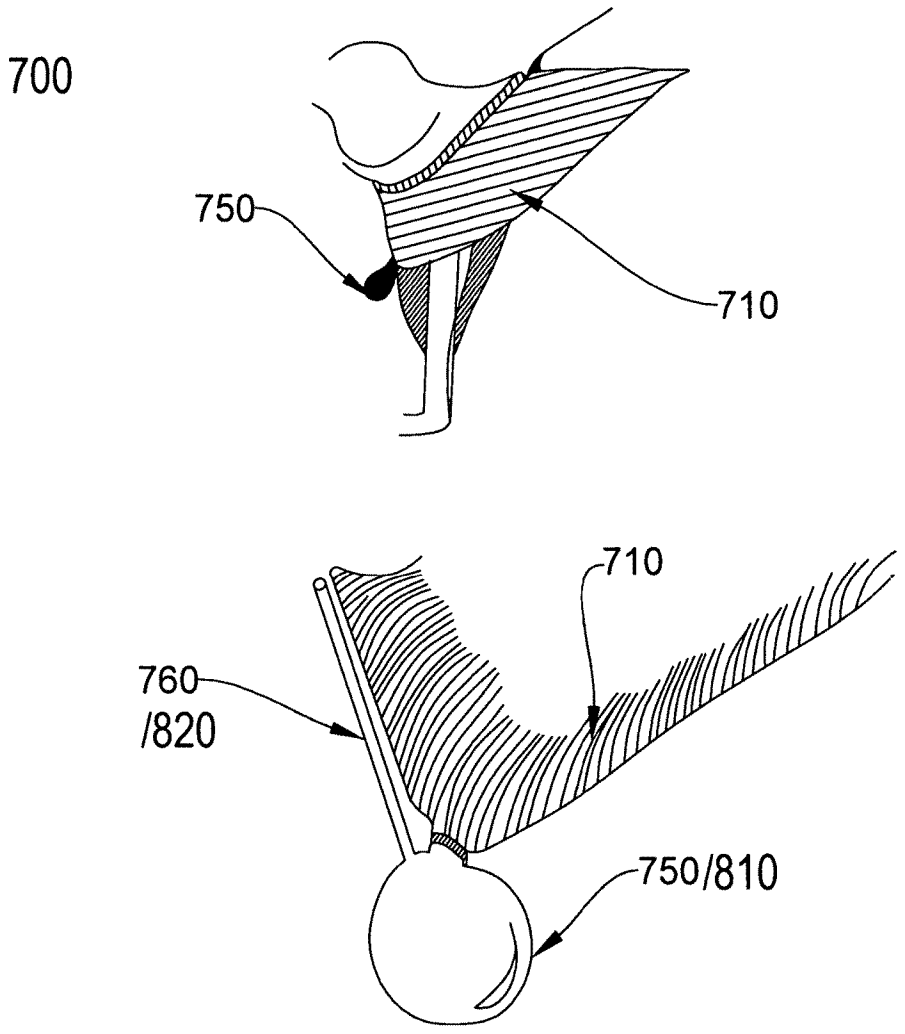
FIG. 7 is a side perspective of the collar-shaped liquid bladder for pets with a squeeze pump and drinking straw attached.

In a further embodiment, as illustrated in FIG. 7 a water bladder for pets 700 is illustrated. A "collar-shaped" liquid bladder 710 that is mounted around the neck of a dog, cat, or similar pet is offered. This "collar-shaped" liquid bladder 710 has a distal end with a re-sealable opening for liquids such as water 740. On an opposite distal end, the "collar-shaped" liquid bladder has a manual squeeze pump 750 for pulling the liquid out of the bladder 710 and forcing it through a drinking attachment 760 such as straw. The drinking attachment 760 can be fixed or removable attached to the "collar-shaped" liquid bladder 710 and it can include a straw or trough 760 for quickly dispensing water or liquid to a pet.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. A V-shaped liquid bladder comprising:

a left wing and a right wing, wherein the left wing joins the right wing to create a substantially hollow volume for storing liquids, the left wing and the right wing being oriented to have upper ends distal each other and lower ends converging towards each other to form a junction;

additional hollow arms extend from and are in fluid communication with a lower portion of the wings to create additional volume, wherein a first arm extends from the left wing and a second arm extends from the right wing;

receptacles are provided for attaching one or more shoulder straps along the upper ends of each of the left and right wings and wherein, the opposite ends of the shoulder straps are attached to distal ends of each of the additional arms of the liquid bladder:

a lower portion of the junction forms a funnel for dispensing the liquids;

the funnel is attached to a drinking pipe, and the drinking pipe allows liquids to flow to an upper distal end of the left or right wing for accessing the liquids within the volume.

2. The liquid bladder according to claim 1, wherein the shoulder straps can connect to create an "X" shape across a user's chest.

3. The liquid bladder according to claim 1, wherein the liquid bladder is comprised of silicone, plastic, or a blend of silicone and plastic and anti-molding material.

4. The liquid bladder according to claim 1, wherein the drinking pipe can be fixed or removably attached from a center of the funnel.

5. The liquid bladder according to claim 1, wherein the drinking pipe is incorporated into seams of the bladder on the left or right side of the bladder and extends to an upper distal end of the left or right wings of the bladder.

6. The liquid bladder according to claim 1, wherein the drinking pipe can be fixed or removably attached to the funnel and laid across a rear facing surface of the bladder to an upper distal end of the left or right wings of the bladder using a hook and fastener, hoop channels, or other attachment means.

7. The liquid bladder according to claim 1, wherein the liquid bladder is divided along its center line into left and right portions, creating separate left and right chambers for liquids.

8. The liquid bladder according to claim 7, wherein the separate left and right chambers for liquids flow respectively, into segregated left and right portions of the funnel at a lower distal end of the bladder; and wherein the segregated left and right portions of the funnel flow into separate drinking pipes on the left and right sides of the bladder.

9. The liquid bladder according to claim 8, wherein the separate left and right drinking pipes are incorporated into respective seams of the wings on the left and right sides of the bladder.

10. The liquid bladder according to claim 1, wherein the drinking pipe includes a freezable component positioned inline to the center of the drinking pipe to chill liquids that flow around it.

11. The liquid bladder according to claim 1, wherein the drinking pipe includes a water filtration component that is placed in-line with the liquid flow of the drinking pipe, thereby allowing a user access to filtered liquids.

12. The liquid bladder according to claim 1, wherein a fluid flow sensor is placed in-line with the fluid flow of the drinking pipe; and wherein the fluid flow sensor includes a wired or wireless connectivity to a computing device such as a mobile phone, tablet, or computer to track a user's liquid consumption.

13. The liquid bladder according to claim 1, wherein wired or wireless speakers and microphones are placed on the shoulder straps of the bladder to enable a user to listen to audio or take a phone call while using the liquid bladder.

14. The liquid bladder according to claim 1, wherein a body-facing side of the bladder incorporates a series of spaced-apart bumps or other protrusions that protrude out from a flat surface of the liquid bladder, thereby allowing airflow between the surface of the liquid bladder and a user's body.

15. A wearable liquid bladder comprising, a left wing and a right wing, the right wing having an upper end and an oppositely disposed lower end, the left wing having an upper end and an oppositely disposed lower end, wherein the lower end of the left wing joins the lower end ofthe right wing to create a substantially hollow volume for storing liquids, the left wing and right wing diverging from each other as they extend upwardly from the lower ends towards the upper ends of the left and right wings;

receptacles are provided for attaching one or more shoulder straps along the upper ends of each of the left and right wings and wherein, the opposite ends of the shoulder straps are attached to distal ends of additional arms of the liquid bladder to create hoops for placing the shoulder straps over the left and right shoulders of a user;

the additional arms extend from and are in in fluid communication with a lower portion of the wings to create additional volume, wherein one arm extends from the left wing and another arm extends from the right wing;

the wings and the arms meet at the lower ends ofthe wings to create a funnel for dispensing the liquids;

the funnel is attached to an outlet pipe, and the outlet pipe allows liquids to flow to the upper ends of the left or right wing; wherein a drinking pipe can be attached to access the liquids within the volume.

16. The wearable liquid bladder according to claim 15, wherein the receptacles can be fixedly or removably attached to the ends of the left and right wings.

17. The wearable liquid bladder according to claim 15, wherein the shoulder straps can connect to create an "X" shape across a user's chest.

18. The wearable liquid bladder according to claim 15, wherein the drinking pipe is incorporated into seams of the bladder on the left or right side of the bladder and extends to an upper distal end of the left or right wings of the bladder.

* * * * *